US007117623B2

(12) United States Patent
Moore

(10) Patent No.: US 7,117,623 B2
(45) Date of Patent: Oct. 10, 2006

(54) FRAME CONSTRUCTION FOR WITH REMOVABLE SIDE PLATE

(76) Inventor: Wildey J. Moore, 45 Angevine Rd., Warren, CT (US) 06794

( * ) Notice: Subject to any disclaimer, the term of this patent is extended or adjusted under 35 U.S.C. 154(b) by 0 days.

(21) Appl. No.: 10/527,858

(22) PCT Filed: Sep. 25, 2003

(86) PCT No.: PCT/US03/30684

§ 371 (c)(1),
(2), (4) Date: Mar. 15, 2005

(87) PCT Pub. No.: WO2004/033984

PCT Pub. Date: Apr. 22, 2004

(65) Prior Publication Data

US 2005/0268514 A1 Dec. 8, 2005

Related U.S. Application Data

(60) Provisional application No. 60/417,023, filed on Oct. 7, 2002.

(51) Int. Cl.
*F41C 23/10* (2006.01)

(52) U.S. Cl. ..... 42/71.02

(58) Field of Classification Search ..... 42/69.03, 42/71.02

See application file for complete search history.

(56) References Cited

U.S. PATENT DOCUMENTS

| | | | | |
|---|---|---|---|---|
| 1,407,959 | A * | 2/1922 | Stokke | 42/25 |
| 3,016,646 | A * | 1/1962 | Smith | 42/69.03 |
| 4,967,503 | A | 11/1990 | Faraar | |
| 5,231,237 | A * | 7/1993 | Cupp | 42/71.02 |
| 5,669,169 | A | 9/1997 | Schmitter et al. | |
| 6,000,162 | A | 12/1999 | Hochstrate | |

* cited by examiner

*Primary Examiner*—Stephen M. Johnson
(74) *Attorney, Agent, or Firm*—McCormick, Paulding & Huber LLP

(57) ABSTRACT

Frame construction for a firearm (10) with a frame (18) and a slide (12) constrained to move longitudinally between a forward and a rearward position but which is also removable from the frame. A recess (39) in the side of the frame contains the Kammer trigger mechanism (26, 38) that is accessible through a side opening (40) in the frame. A thin side plate (42) drops over the side opening and is held at its side edges and bottom edge by flanges (50) an the side plate overlapping congruent grooves in the frame and is held in place an top by the slide. After removing the slide in the conventional manner, the side plate can be slide upwardly and removed using a finger cutout (48) in the side plate.

5 Claims, 3 Drawing Sheets

FRAME CONSTRUCTION FOR WITH REMOVABLE SIDE PLATE

CROSS REFERENCE TO RELATED APPLICATIONS

This application claims the benefits of prior filed, co-pending U.S. provisional patent application Ser. No. 60/417,023 filed on Oct. 7, 2002 and International Application No. PCT/US2003/030684 filed on Sep. 25, 2003.

TECHNICAL FIELD

This invention relates to an improved frame construction for a firearm. More particularly, it relates to an improved frame construction for a firearm of the type having a longitudinally movable slide on the frame and a hammer trigger mechanism in the frame for operating the firearm.

BACKGROUND ART

A firearm, and in particular an autoloading or automatic firearm, is equipped with an external hammer that can be cocked to the rear and engaged with a sear and then tripped by squeezing the trigger which engages the sear by means of linkage releasing its engagement to the hammer (single action letoff). Alternatively, the hammer can be drawn to the rear for release and firing by squeezing the trigger without first cocking the hammer. This is accomplished through the linkage system engaging the hammer with the trigger for the aforementioned purpose; pulling the hammer rearward and releasing it before it can be engaged by the sear (double action letoff).

This invention relates to firearms functioning in the aforementioned manner incorporating a hammer spring, usually located in an area behind the magazine well in the frame and consisting of various components to accomplish the single action and double action letoffs. Historically, it is not recommended that anyone but an accomplished gunsmith work on these mechanisms as they are complicated and improper assembly or disassembly is very likely to occur. Usually, tools are required to disassemble the firearm, so as to gain access to the hammer trigger mechanism or action of the firearm. The invention addresses these issues by accomplishing the same objectives but with basic components that anyone with an aptitude for mechanics can easily understand, and enables access easily to the hammer trigger mechanism without the need of tools.

Accordingly, one object of the present invention is to provide a simplified frame construction giving access to the hammer trigger mechanism for a firearm.

Another object of the invention is to provide a simplified construction for gaining access to the firearm action without the need of tools.

Another object of the invention is to provide an improved frame construction which simplifies cleaning or repair of the hammer trigger mechanism.

DISCLOSURE OF INVENTION

An improved frame construction for a firearm of the type having a frame having a top planar surface, a slide constrained to move longitudinally between a forward and a rearward position with respect to the barrel, the slide defining a bottom planar surface extending parallel to the frame top surface, the slide being removable from the frame, a barrel disposed in the slide for receiving a cartridge, a firing pin longitudinally slidable in the slide so as to strike the cartridge, a hammer arranged to strike the firing pin, a trigger, and a hammer trigger mechanism arranged to release the hammer when the trigger is pulled, the improvement comprising the frame having a side opening beneath the slide commencing at the frame top surface and defining a recess in the side of the frame, the hammer trigger mechanism being disposed in the recess and accessible through the side opening, a side plate arranged to cover the side opening, the side plate and the frame opening having congruent interlocking means arranged to permit only upward movement of the side plate, and the side plate having a top planar surface disposed to be held against upward movement by the slide bottom planar surface when the slide moves longitudinally between forward and rearward positions, the slide being removable from the frame to release the side plate for upward movement when the slide is removed.

BRIEF DESCRIPTION OF DRAWINGS

The invention will be better understood by reference to the following description, taken in connection with the accompanying drawings, in which.

BEST MODE FOR CARRYING OUT THE INVENTION

Figure 1:
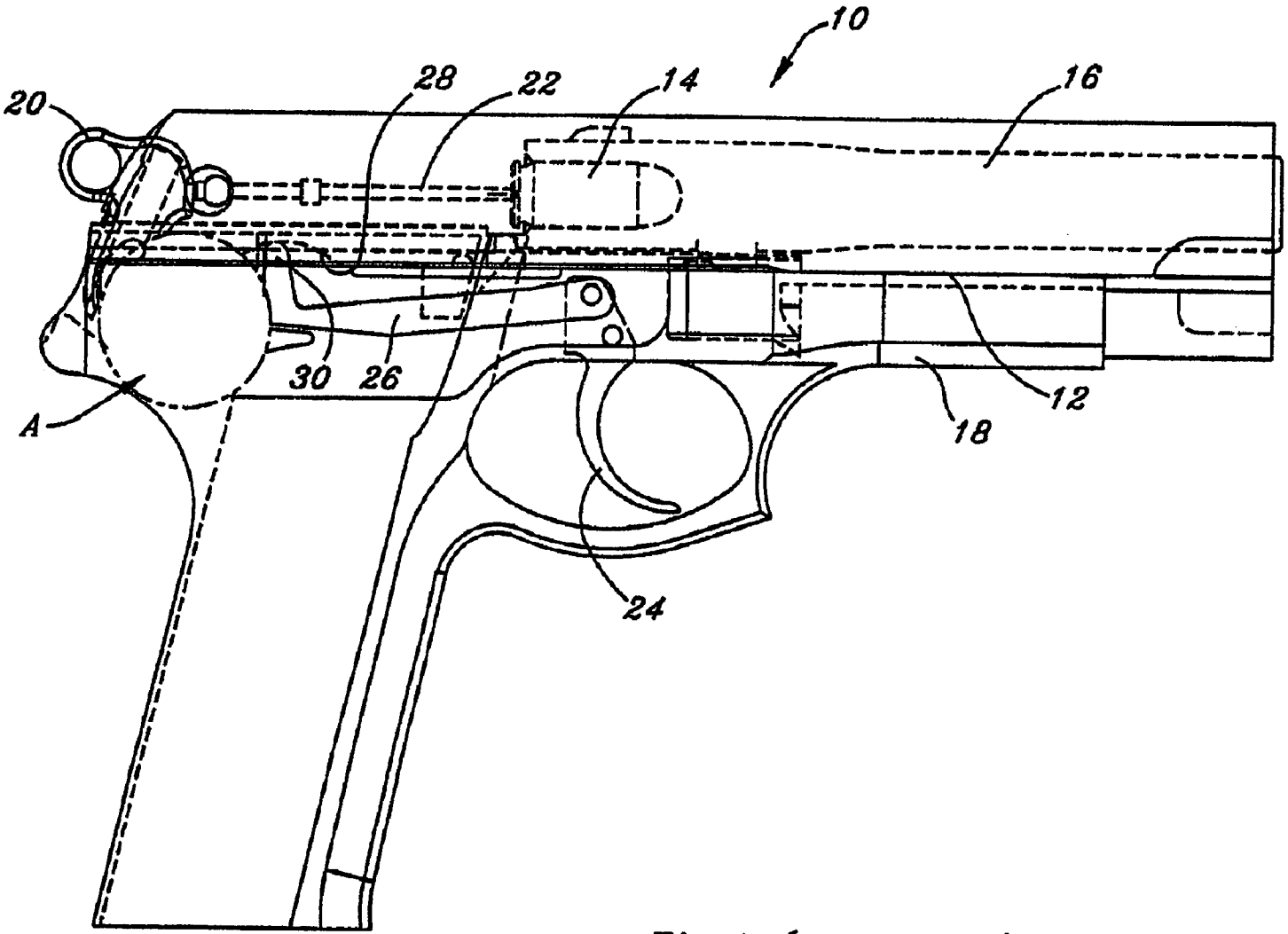
Fig. 1 (Prior Art)
FIG. 1 is a side elevational drawing, partly in section, of portions of a semi-automatic firearm.

Referring now to FIG. 1 of the drawing, the invention is described as embodied in a semi-automatic firearm 10 of the type using a spring-loaded cartridge magazine (not shown) and having a reciprocating slide 12 adapted to move from a forward position in a rearward direction against a recoil spring (not shown) when a cartridge 14 is fired. During the rearward movement, the shell of cartridge 14 is ejected, and during the return forward movement, a new cartridge is stripped from the magazine by the extractor and inserted into the bore of a barrel 16 in a manner well known in the art. Slide 12 is reciprocable in tracks upon a frame 18. A hammer 20 is pivotably mounted on frame 18 to strike a firing pin 22, which is longitudinally slidable in the slide 12 so as to strike the rear of cartridge 14. A trigger 24 is pivotably mounted in the frame and connected to push or pull a transfer bar 26. Slide 12 includes a cam surface 28, which cooperates with a first finger 30 to raise or lower the end of transfer bar 26 when the transfer bar is pushed or pulled longitudinally by the trigger 24. The foregoing list of elements describes one construction for a hammer trigger mechanism or action known in the prior art. Other types of hammer trigger mechanisms or actions are also known, the details of which are not relevant, since any type of hammer trigger mechanism is applicable to the present invention. The invention relates to improvements in the frame construction to enable easy access to the hammer trigger mechanism, as illustrated in the following figures.

Figure 2:
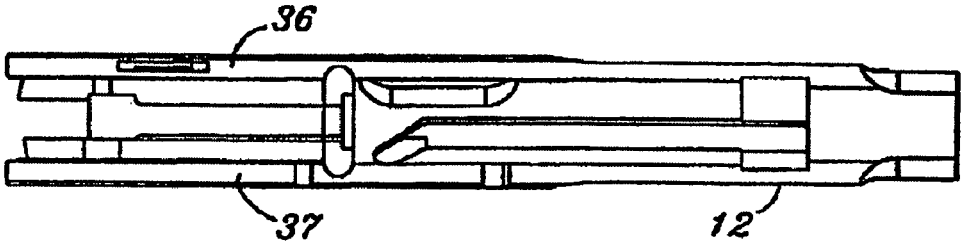
FIG. 2 is a bottom plan view of the slide of the firearm.
Figure 3:
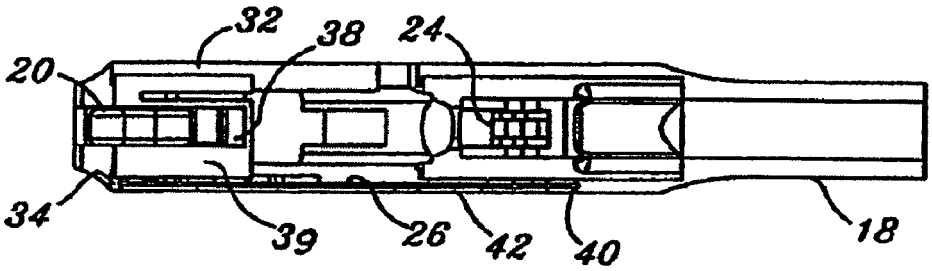
FIG. 3 is a top plan view of the frame of the firearm.

A bottom view of slide 12 is shown in FIG. 2, having planar bottom surfaces 36, 37. A top view of the frame 18, with slide 12 removed is shown in FIG. 3. Frame 18 includes planar top surfaces 32, 34. Planar surfaces 36, 37 of slide 12 extending longitudinal and parallel to the top planar surfaces 32, 34 of the frame 18.

Figure 4:
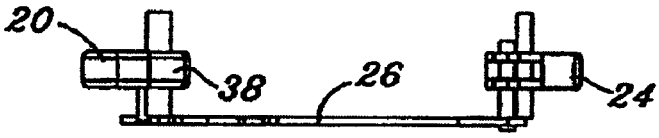
FIG. 4 is a top plan view of the major components of the hammer trigger mechanism.

FIG. 3 illustrates the hammer 20 and trigger 24 disposed in a recess 39 of the frame. The hammer trigger mechanism includes the transfer bar 26, a sear 38 and other pins and linkages not material to the present invention. FIG. 4 illustrates the hammer trigger mechanism without the frame, having the same elements as identified in FIG. 3.

Figure 5:
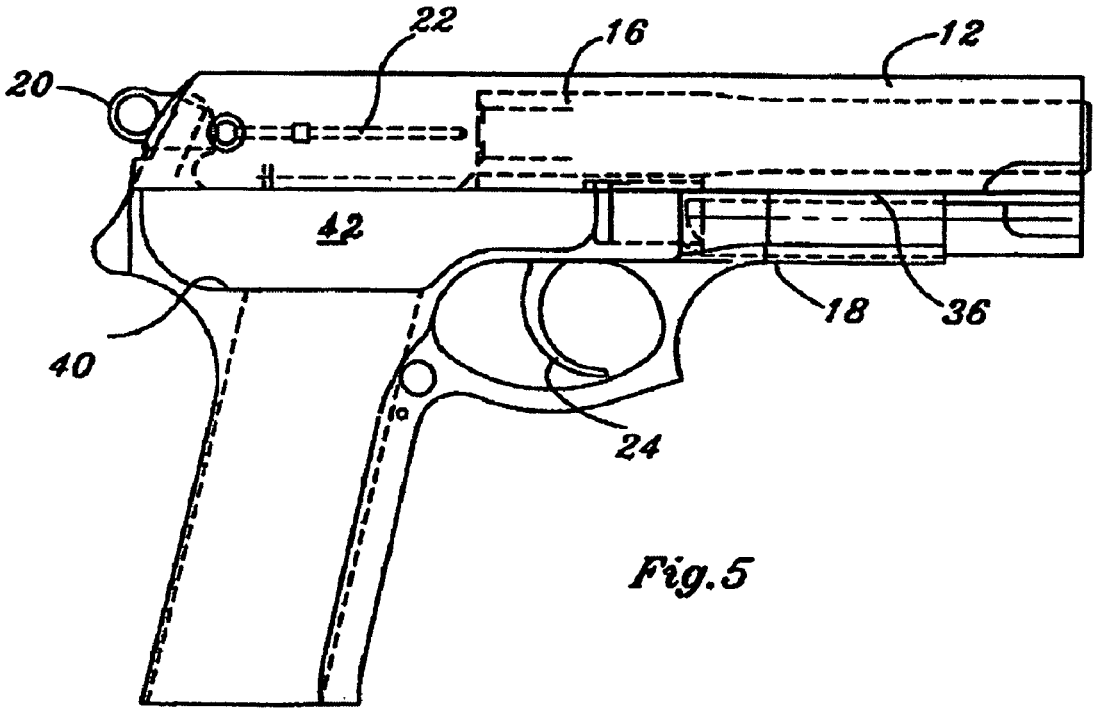
FIG. 5 is a side elevational drawing of the firearm showing the side plate location.
Figure 6:
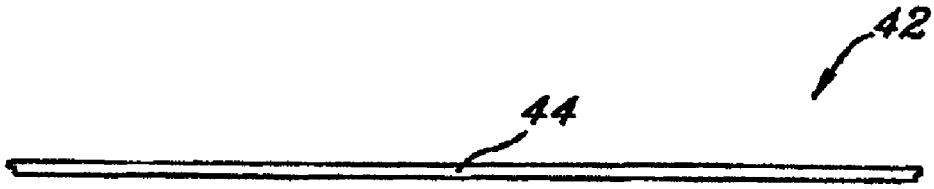
FIG. 6 is a top plan view of the side plate used in the present invention.
Figure 7:
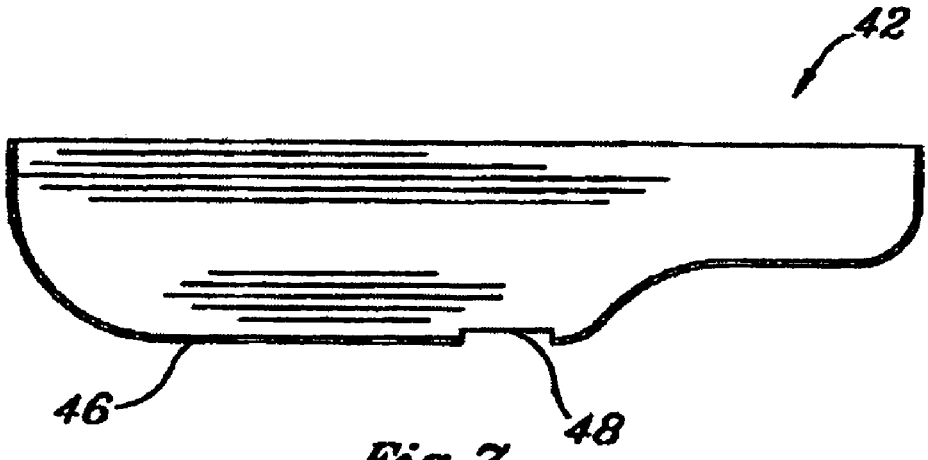
FIG. 7 is a side elevational view of the side plate used in the present invention.
Figure 8:
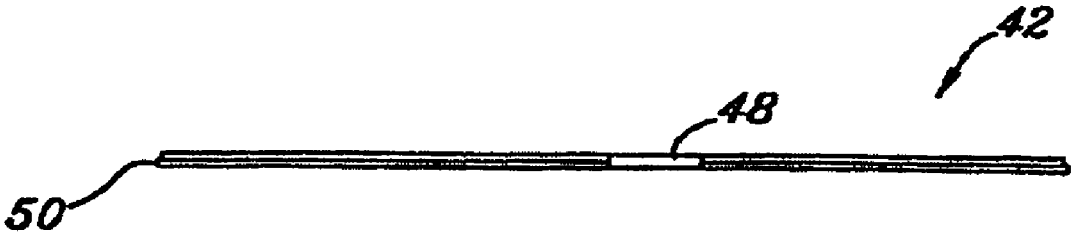
FIG. 8 is a bottom plan view of the side plate used in the present invention.

In accordance with the present invention, the hammer trigger mechanism of FIG. 4 is disposed in the recess 39. Recess 39 is accessible through a side opening 40 cut in the side of the frame 18. The elements of the hammer trigger mechanism may be accessed and removed for cleaning and/or repair through the side opening 40. Side opening 40 is closed and covered by a side plate 42 shown in FIG. 5 of the drawing. Side plate 42 is illustrated in FIGS. 6, 7 and 8 of the drawing as a thin metal plate having the same shape as the side opening 40. As shown in FIG. 6, a top edge 44 has a planar surface. The side and bottom edges 46, shown in FIG. 7 are milled out to leave a narrow flange 50 running around the side and bottom edges 46. The flange is interrupted by a cutout 48. FIG. 8, showing the bottom plan view indicates the small flange 50.

Referring to FIG. 3 of the drawing, the side plate 42 is shown covering the side opening 40 leading into recess 39. The bottom and side of the side opening 40 is cut out with a groove congruent to the bottom and side edges of side plate 42 to receive flange 50. Thus congruent interlocking edges, with the exception of the top side of side opening 40 permit only upward movement of the side plate 42 and the frame. When side plate 42 is in the frame, its top planar edge 44 is flush with the top planar surfaces 32, 34 of the frame and thus held in position by slide 12.

Slide 12 is removable from frame 18 in a manner well known to those skilled in the art by removing a slide retainer pin. When the slide is removed, side plate 42 may be moved upwardly with the assistance of the cutout 48 in the side plate, without the aid of tools. In this matter, access to the hammer trigger mechanism from the side of the frame through a side plate removable without tools provides a substantial advantage over prior art firearms of this type.

While there has been described what is considered to be the preferred embodiment of the invention, other modifications will occur to those skilled in the art. It is desired to secure all such modifications as fall within the true spirit and scope of the invention.

The invention claimed is:

1. An improved frame construction for a firearm having a frame having a side terminating at a top planar surface, a slide constrained to move longitudinally between a forward and a rearward position, said slide defining a bottom planar surface extending parallel to and slidable across said frame top surface, said slide being removable from the frame, a barrel for receiving a cartridge, a firing pin longitudinally movable in the slide so as to strike the cartridge, a hammer arranged to strike the firing pin, a trigger, and a hammer trigger mechanism arranged to release the hammer when the trigger is pulled, said improvement comprising:

said frame having a side opening commencing at said frame top planar surface and defining a recess in the side of the frame facing said side opening, said hammer trigger mechanism being disposed in said recess and accessible through said side opening, a side plate arranged to cover said side opening and arranged to be movable upwardly toward said slide, said side plate having a top planar surface disposed to be held in place by said slide bottom planar surface when the slide moves longitudinally between said forward and said rearward positions, said slide being removable from the frame to release the side plate when the slide is removed.

2. Improved frame construction in accordance with claim 1, wherein said side plate and said side opening have congruent interlocking edges arranged to permit only upward movement of the side plate, and wherein said slide bottom planar surface prevents upward movement of the side plate when the slide moves longitudinally between forward and rearward positions.

3. Improved frame construction in accordance with claim 2, wherein said side plate includes side edges and a bottom edge each defining a flange, and wherein said side opening includes side edges and a bottom edge each defining a groove, said flange and said groove arranged and dimensioned to retain the side plate against outward movement with respect to the frame.

4. Improved frame construction in accordance with claim 2, wherein said side plate defines a bottom edge and wherein said bottom edge is interrupted to provide a cutout adapted for use to over the side plate in an upward direction to remove the side plate after the slide has previously been removed.

5. Improved frame construction in accordance with claim 1, wherein the length of said side plate between its side edges is substantially the same as the distance between said trigger and said hammer of the firearm.

* * * * *

UNITED STATES PATENT AND TRADEMARK OFFICE

CERTIFICATE OF CORRECTION

PATENT NO. : 7,117,623 B2
APPLICATION NO. : 10/527858
DATED : October 10, 2006
INVENTOR(S) : Wildey Moore It is certified that error appears in the above-identified patent and that said Letters Patent is hereby corrected as shown below:

On the front page, the title is incorrect and should read as follows:

FRAME CONSTRUCTION FOR A FIREARM WITH REMOVABLE SIDE PLATE

In the Abstract, line 11, “slide” should be --slid--.

Column 4, line 45, “over” should be --move--.

Signed and Sealed this

Ninth Day of January, 2007

JON W. DUDAS
*Director of the United States Patent and Trademark Office*